US006059240A

United States Patent [19]

Gorsuch

[11] Patent Number: 6,059,240

[45] Date of Patent: May 9, 2000

[54] BOW SUPPORT

[76] Inventor: Timothy M. Gorsuch, S78 W29728 Crossgate Dr., Mukwonago, Wis. 53149

[21] Appl. No.: 09/085,121

[22] Filed: May 27, 1998

[51] Int. Cl.[7] ..... A47B 96/06

[52] U.S. Cl. ..... 248/219.4; 124/86

[58] Field of Search ..... 248/122.1, 123.11, 248/125.8, 218.4, 216.1, 219.1, 219.2, 219.4, 279.1, 284.1, 286.1, 558, 692, 280.11, 278.1; 124/1, 23.1, 86, 89

[56] References Cited

U.S. PATENT DOCUMENTS

| | | | |
|---|---|---|---|
| 584,871 | 6/1897 | Gordon | 248/278.1 X |
| 3,136,519 | 6/1964 | Spriggle | 248/230.8 |
| 3,185,422 | 5/1965 | Spindler | 248/125.1 |
| 3,776,498 | 12/1973 | Peters et al. | 248/219.1 |
| 4,470,106 | 9/1984 | Norton | 248/278.1 X |
| 4,542,873 | 9/1985 | Matherly et al. | 248/218.4 |
| 4,708,221 | 11/1987 | Kubiak | 182/187 |
| 4,722,501 | 2/1988 | Ruhl | 248/218.4 |
| 4,729,363 | 3/1988 | Skyba | 124/23 R |
| 4,744,537 | 5/1988 | Buckley | 248/219.1 |
| 5,263,675 | 11/1993 | Roberts et al. | 248/219.4 |
| 5,310,150 | 5/1994 | Fecko | 248/218.2 |
| 5,310,151 | 5/1994 | Engel | 248/230.8 |
| 5,482,241 | 1/1996 | Oglesby | 248/309.1 |
| 5,484,253 | 1/1996 | Johnson | 414/787 |
| 5,619,981 | 4/1997 | Breedlove | 124/89 |
| 5,692,716 | 12/1997 | Himmelsbach | 248/216.1 |
| 5,727,760 | 3/1998 | Wytovak et al. | 248/217.3 |
| 5,769,372 | 6/1998 | Klosterman | 248/219.4 |
| 5,806,508 | 9/1998 | Stempien et al. | 124/86 |
| 5,857,651 | 1/1999 | Kunevicius | 248/230.8 |

OTHER PUBLICATIONS

Page containing description of KLAWHORN REDI–REACH taken from Bowhunter's Warehouse Catalog.

*Primary Examiner*—Anita M. King
*Attorney, Agent, or Firm*—Jansson, Shupe, Bridge & Munger, Ltd.

[57] ABSTRACT

The invention provides a portable bow holder which is removably attached to a tree or other vertical support. The device has an arm that is adjustable in length and is capable of rotating horizontally around the point of attachment so that the holder may be aimed in varying directions around the hunter. A bow hook for holding the bow is also adjustable in a vertical plane to allow the hunter to position the bow at the proper height. In a preferred embodiment, the arm of the device automatically retracts out of the hunter's line of vision when the weight of the bow is removed, thereby enhancing the hunter's opportunity to successfully target the prey. Preferably, the rate of retraction of the arm can be adjusted by the hunter by rotating a hydraulic cylinder attached to both the arm and body of the device. The device also requires little movement by the user and therefore promotes a success hunt and hunter safety. The device further provides flexibility in use since different embodiments allow placement of the device either under or above the user.

20 Claims, 8 Drawing Sheets

BOW SUPPORT

FIELD OF THE INVENTION

This invention relates generally to hunting accessories and, more particularly, to devices that assist a bow hunter in supporting a bow when hunting from a tree stand or on the ground.

BACKGROUND OF THE INVENTION

A major problem encountered in hunting deer or other game from a tree stand with a bow is that deer are easily "spooked" by sudden movement. A hunter may be waiting in a tree stand for several hours before seeing a deer and, because a bow is quite heavy, it is not possible for the hunter to continuously hold the bow in a fixed position desirable for aiming. Furthermore, deer may come within range from various different directions around a tree stand and the hunter has to be prepared to shift his aim depending upon the approach of the animal. Another problem is that bow holding devices may get in the way of the hunter when he is attempting to aim the bow, resulting in missed opportunities and potential accidents.

The known bow support devices of the prior art have certain disadvantages and limitations. Although the devices of the prior art may be used to support the weight of the bow during extended periods of time while the hunter is waiting to spot game, the bow cannot be easily disengaged without sufficient movement and/or noise to alert the intended prey to the hunter's presence. This movement has a tendency to scare the game away and is likely to result in lost opportunities for the hunter. Such devices include, for example, U.S. Pat. No. 5,482,241, where the bow must be rotated to remove it from position in the bow holder.

Another disadvantage of the devices of the prior art is apparent in such devices as that shown in U.S. Pat. No. 5,310,150. Although this device and others like it may allow easy disengagement of the bow, they remain in place after the bow is removed for use, thereby potentially interfering with the hunter's line of vision or freedom of movement in aiming at the intended target. Such devices also create the potential for accident if the hunter inadvertently comes in contact with the device.

The prior art also does not provide a device that will rotate or swivel in multiple horizontal directions around the hunter so that it can be used to support the bow while aiming at the intended target or moved out of the way in a horizontal or vertical direction when desired. Most of the devices of the prior art also do not have the telescoping capability of the invention, which allows for adjustment in device arm length to suit the individual needs of a particular the hunter. Furthermore, the prior art does not generally provide for adjustment of the bow hook in a vertical plane relative to the arm of the device.

Another concern not adequately addressed by the prior art is safety, since such prior art devices require the hunter to either turn his body to pick up the bow or to move after taking the bow off of its support so as to have a clear line of vision for aiming purposes. This movement is most likely to be required when prey has been spotted and the hunter is excited.

Such excess movement might not only disturb the prey, thereby lessening the possibility of a successful hunt, but might also tend to result in a greater risk of accidents to the hunter. In particular, the bow may snag on a branch or on the support as the hunter is turning, making a fall from the tree stand more likely.

Furthermore, there is a need for a flexible design that can be used in several alternative ways, either below or above the tree stand. Since trees vary in terms of branch placement and since the tree stand may be used in varying locations or on differently configured trees, it is useful for the hunter to have a bow holding device that provides various alternative placement possibilities to suit the environment and the user's needs.

OBJECTS OF THE INVENTION

It is an object of the invention to provide an improved bow support for use when hunting deer or other game from a tree stand or on the ground.

Another object of the invention is to provide a bow holding device that is retractable and therefore does not block or otherwise interfere with the user's range of vision when the hunter is aiming toward an intended prey when the bow is fully drawn.

Still another object of the invention is to provide a bow support device that retracts in such a gradual manner that it does not alert the intended prey to the movement of the device.

A further object of the invention is to provide an improved bow support that is easy to use.

Yet another object of the invention is to provide a bow support that will improve the hunter's chances of successfully aiming at and taking intended prey.

Another object of the invention is to provide a bow holding device that requires little movement to disengage the bow from the support when the hunter intends to use the bow.

Still another object of the invention is to provide a device that makes it easier to take aim and successfully shoot the target because no sudden movements by the hunter are required to use the device that might be likely to scare off the intended prey.

Yet another object of the invention is to provide a bow holding device with an arm that can telescope in length, as desired by the hunter, thereby providing easy adjustment to accommodate users having different arm lengths, while maximizing safety in making it easy to disengage the bow from the support.

Still another object of the invention is to provide a bow hook which is adjustable in a vertical plane relative to the arm of the device to allow the hunter to position the bow at the proper height.

Another object of the invention is to provide a bow support device that can be rotated in various horizontal directions after mounting on the tree.

A further object of the invention is to provide a bow supporting device that can be used without requiring that the user's eyes be removed from the prey when the bow is removed from its support, thereby making a successful hunt more likely.

Yet a further object of this invention is to provide increased hunting safety since it minimizes the movement necessary to remove the bow from the support and to aim the arrow at the prey.

A further object of this invention is to provide a bow supporting device that is relatively in expensive to manufacture and has a relatively long useful life as a durable good.

Another object of this invention is to provide a bow holding device that is easily installed on any tree yet provides a secure and safe hunting method without damage to the tree.

Yet another object of this invention is to provide a bow supporting device that is collapsible for easy carrying.

Still another object of the invention is to provide a bow supporting device that offers alternative attachments, making mounting possible either above or below a tree stand.

A further object of this invention is to provide the hunter with a device that is adjustable in the rate of climb of the arm by turning the lift cylinder to provide a faster or slower rate of climb, as desired by the user.

How these and other objects are accomplished will become more apparent from the following descriptions and from the drawings.

SUMMARY OF THE INVENTION

The invention involves a bow hunting device for use in holding a bow which may be removably mounted to a vertical support such as a tree. In the improvement, the device has means for removably attaching the device to the vertical support; a body, an upper end and a lower end; an arm, having a first end and a second end, which first end is attached to the lower end of the body; and means for removably holding the bow at the second end of the arm. The device also has means for keeping the arm in a horizontal position when the device is attached to the vertical support and when weight is applied to the bow holding means and for causing the arm to move upwardly toward the upper end of the body when weight is removed from the bow holding means.

In a preferred embodiment, the arm is adjustable in length. The arm may also be rotatable around the body. In a preferred embodiment, the arm is connected to the lower end of the body by arm attachment means having a vertical attachment axis therethrough. In this embodiment, the arm, when horizontal, is perpendicular to a plane containing the vertical attachment axis and may be rotated up to 180 degrees from a point on the plane to another point on the plane in a direction away from the vertical support.

Preferably, the means for removably attaching the device to the vertical support is a mounting strap encircling the circumference of the vertical support, with means to tighten or loosen said strap in combination with at least two braces which are attached to the body, whereby the body can be braced against the vertical support. Ideally, the means for removably holding the bow at the second end of the arm is a hook which is adjustable vertically relative to the arm.

In the preferred embodiment of the device, the means for keeping the arm in a horizontal position when weight is applied to the bow holding means and for causing the arm to move upwardly toward the upper end of the body when weight is removed from said bow holding means is a hydraulic cylinder mounted between the body and the arm, wherein the cylinder pulls the arm upwardly when weight is removed from the bow holding means and further wherein the hydraulic cylinder is adjustable for rate of movement of the arm.

In another aspect of the invention, the device may include a means for removably attaching the device to the vertical support; a body having an upper end and a lower end; an arm having a first end and a second end, which first end is attached to the upper end of the body; means for removably holding the bow at the second end of the arm; and means for keeping the arm in a horizontal position when the device is attached to the vertical support and when weight is applied to the bow holding means and for causing the arm to be pushed upwardly toward the vertical support when weight is removed from the bow holding means.

In this aspect the arm may also be adjustable in length and the arm may be rotatable around the body. The arm is connected to the upper end of the body by arm attachment means having a vertical attachment axis therethrough and the arm, when horizontal, is perpendicular to a plane containing the vertical attachment axis. Ideally, the arm may be rotated up to 180 degrees from a point on the plane to another point on the plane in a direction away from the vertical support.

This embodiment also may have as the means for removably attaching the device to the vertical support, a mounting strap encircling the circumference of the vertical support, with means to tighten and loosen the strap in combination with at least two braces which are attached to the body, whereby the body can be braced against the vertical support. In one embodiment, the means for holding a bow at the second end of the arm is a hook, wherein the hook is adjustable vertically relative to the arm.

In this embodiment of the device, the means for keeping the arm in a horizontal position when weight is applied to the bow holding means and for causing the arm to move upwardly toward the vertical support when weight is removed from said bow holding means is a gas cylinder mounted between the body and the arm, wherein the gas cylinder pushes the arm upwardly when weight is removed from the bow holding means.

In yet another aspect of the invention, the device comprises a means for removably attaching the device to the vertical support; a body; an arm, having a first end and a second end, which first end is connected to the body by attachment means having a vertical attachment axis; and means for removably holding a bow at the second end of the arm, wherein the arm is at least partially rotatable around the vertical attachment axis.

In this embodiment the arm is also preferably adjustable in length and the arm, when horizontal, is perpendicular to a plane containing the vertical attachment axis and further wherein the arm may be rotated up to 180 degrees around the vertical attachment axis in a direction away from the vertical support.

It is also preferred in this embodiment that the means for removably attaching the device to the vertical support is a mounting strap encircling the circumference of the vertical support, with means to tighten or loosen said straps. The device may also have at least two braces attached to the body in order to brace the body against the vertical support.

The preferred means for holding a bow at the second end of the arm in this embodiment is a bracket.

Other aspects of the invention are set forth in the following detailed description and in the drawings.

DETAILED DESCRIPTION OF PREFERRED EMBODIMENTS

Figure 1:
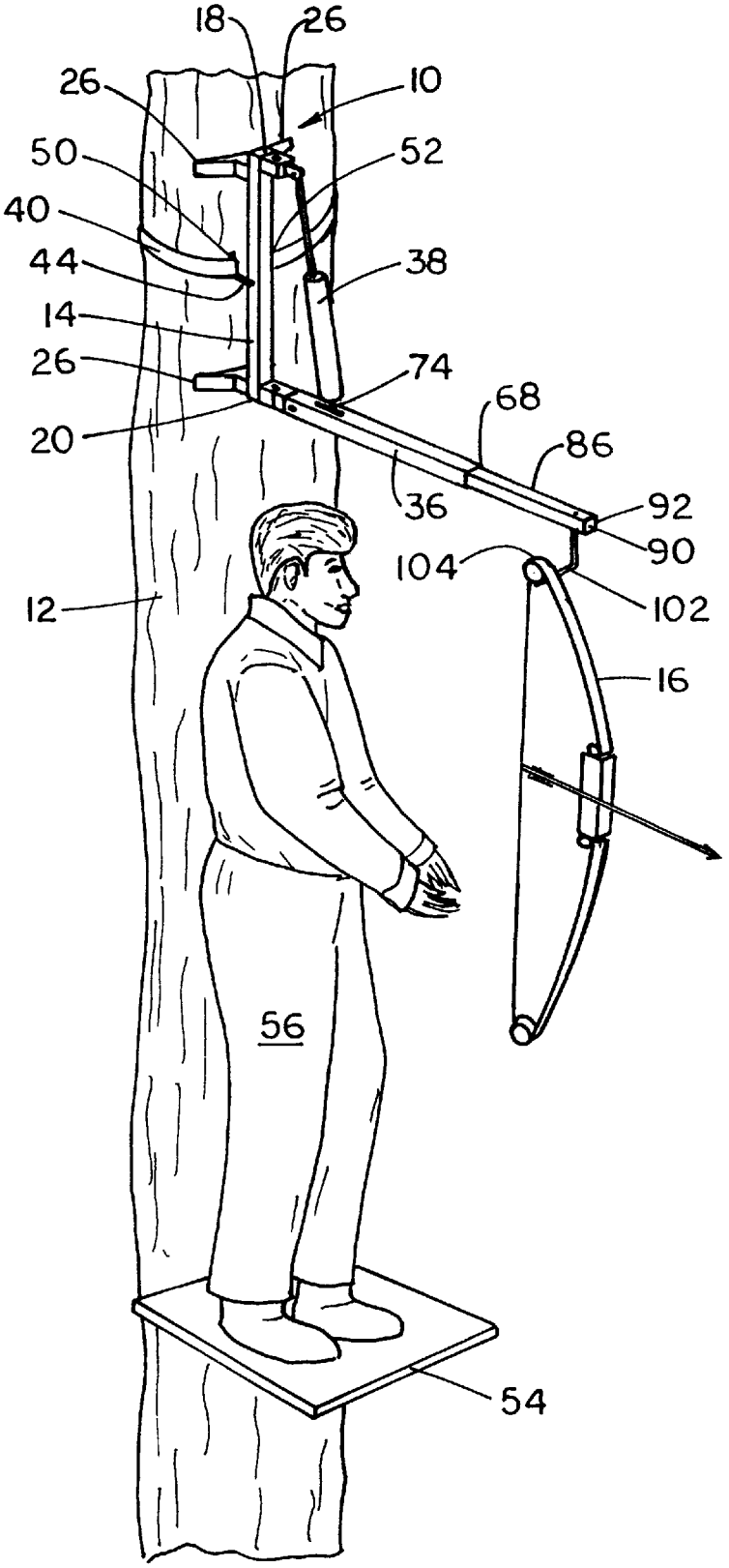
FIG. 1 is a perspective view of the preferred embodiment of the device as attached to a tree, showing placement of the hunter and the bow in relationship to the device.
Figure 2:
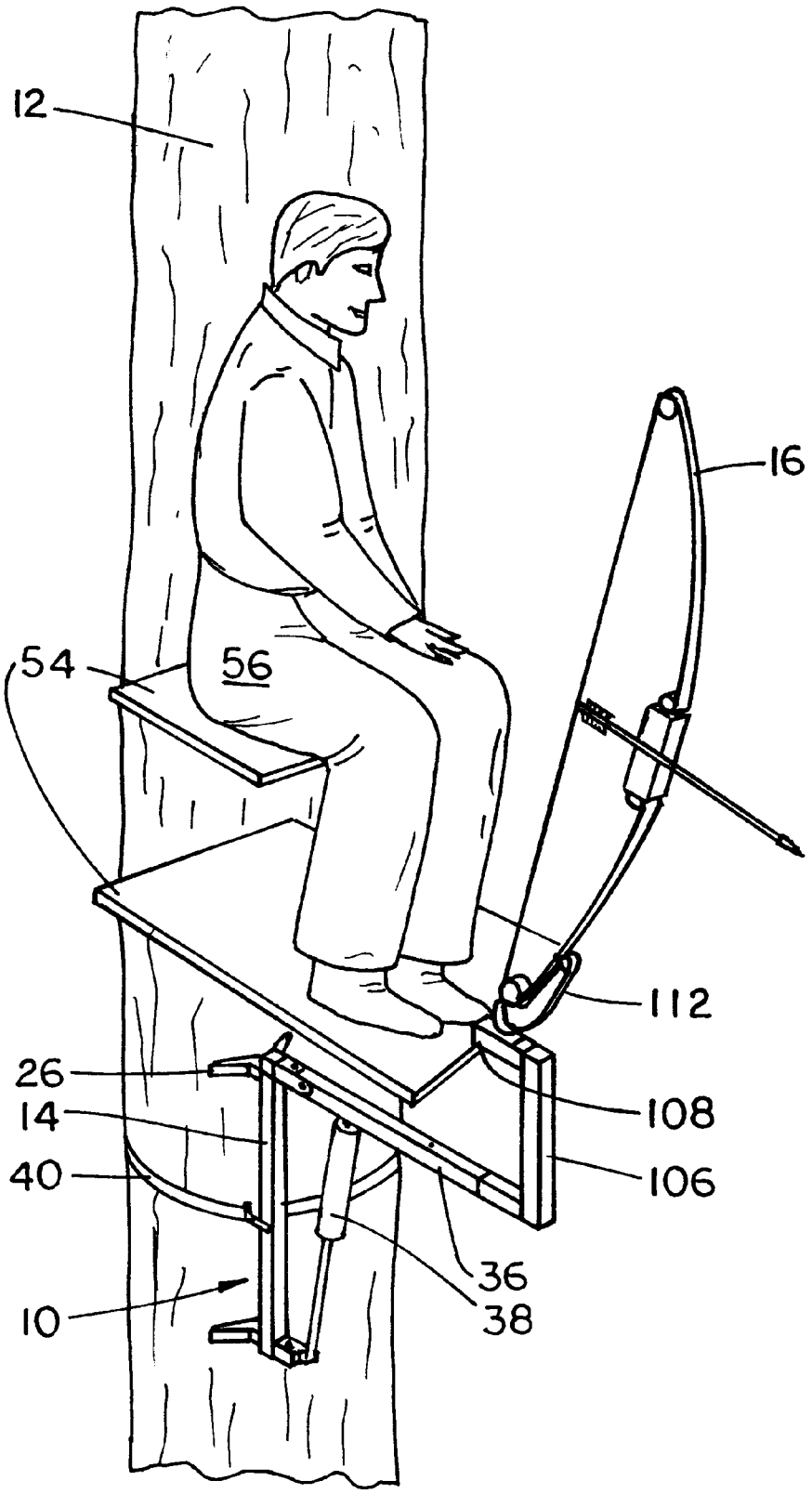
FIG. 2 is a perspective view of the device as shown in FIG. 1 and attached to a tree in an inverted manner and with an alternative arm extension piece and bow support, showing placement of the hunter and the bow in relationship to the device.
Figure 3:
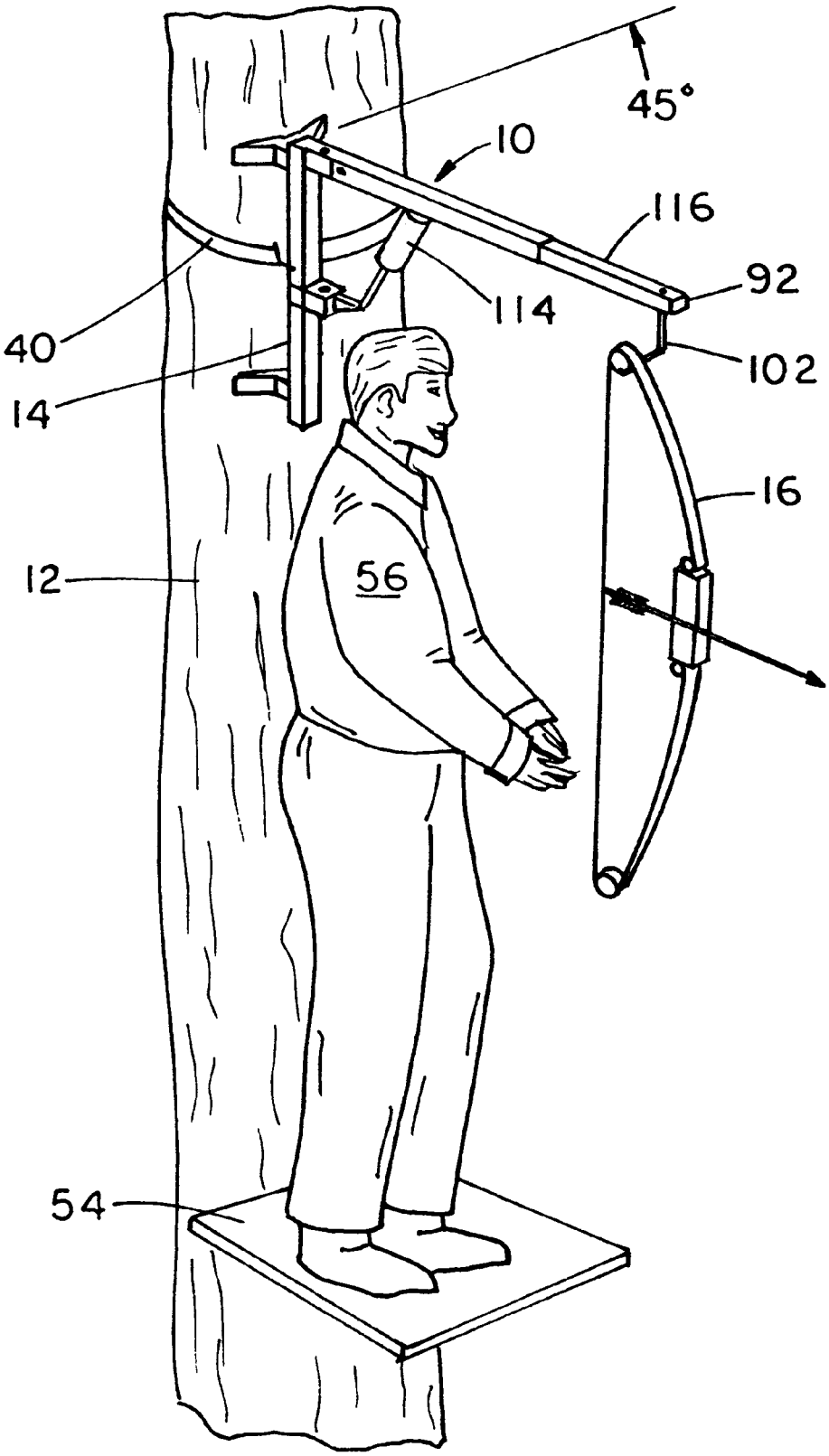
FIG. 3 is a perspective view of another embodiment of the device as attached to a tree, showing placement of the hunter and the bow in relationship to the device.

FIG. 1, 2 and 3 show several embodiments of the new inventive device 10 as it appears when removably attached to a vertical support such as a tree 12. FIG. 1 shows the preferred embodiment shown in a side view in FIG. 4, FIG. 2 shows a second embodiment shown in a side view in FIG. 5, and FIG. 3 shows a third embodiment shown in side view in FIG. 6.

Figure 4:
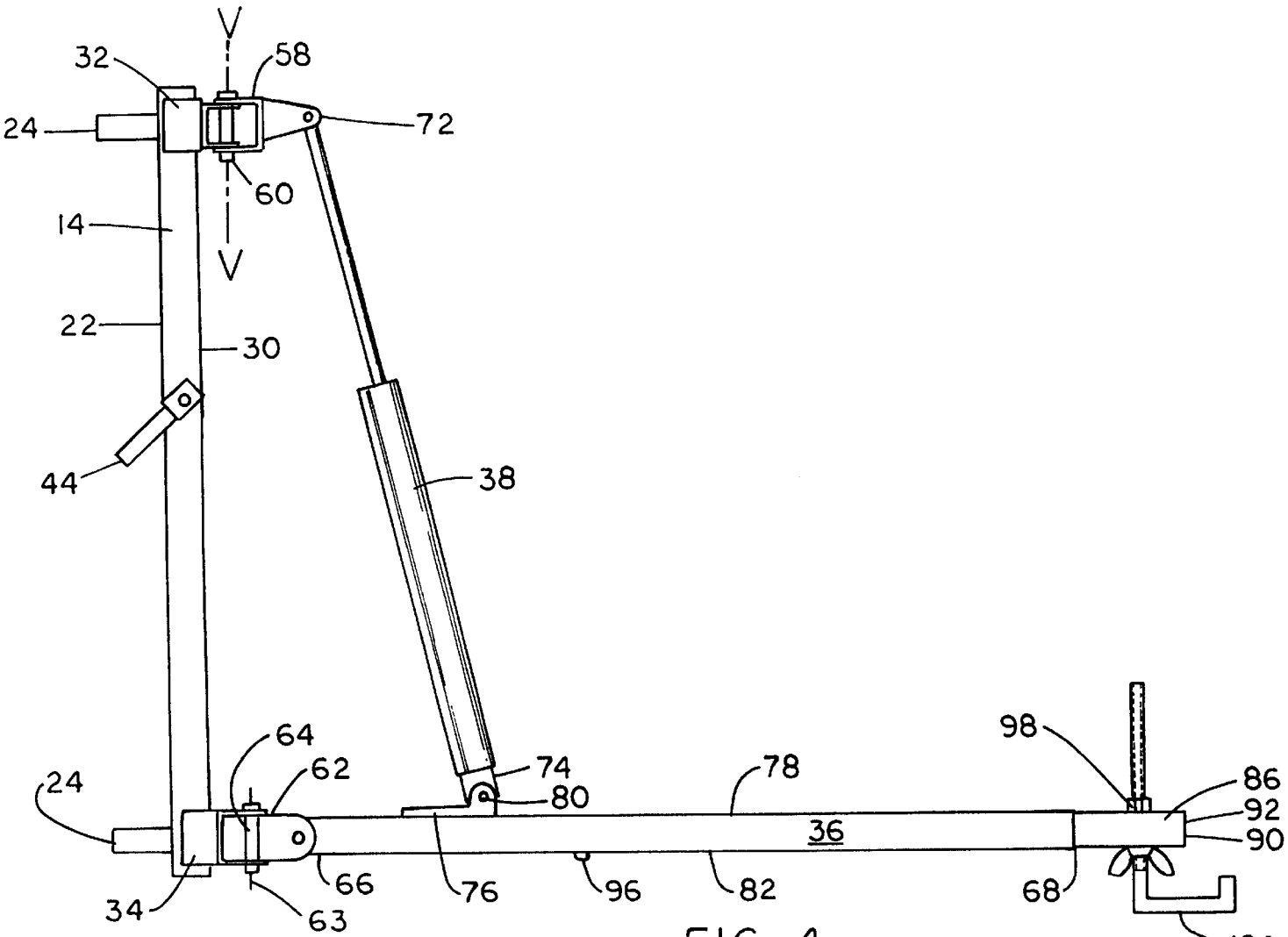
FIG. 4 is a side view of the embodiment shown in FIG. 1.
Figure 5:
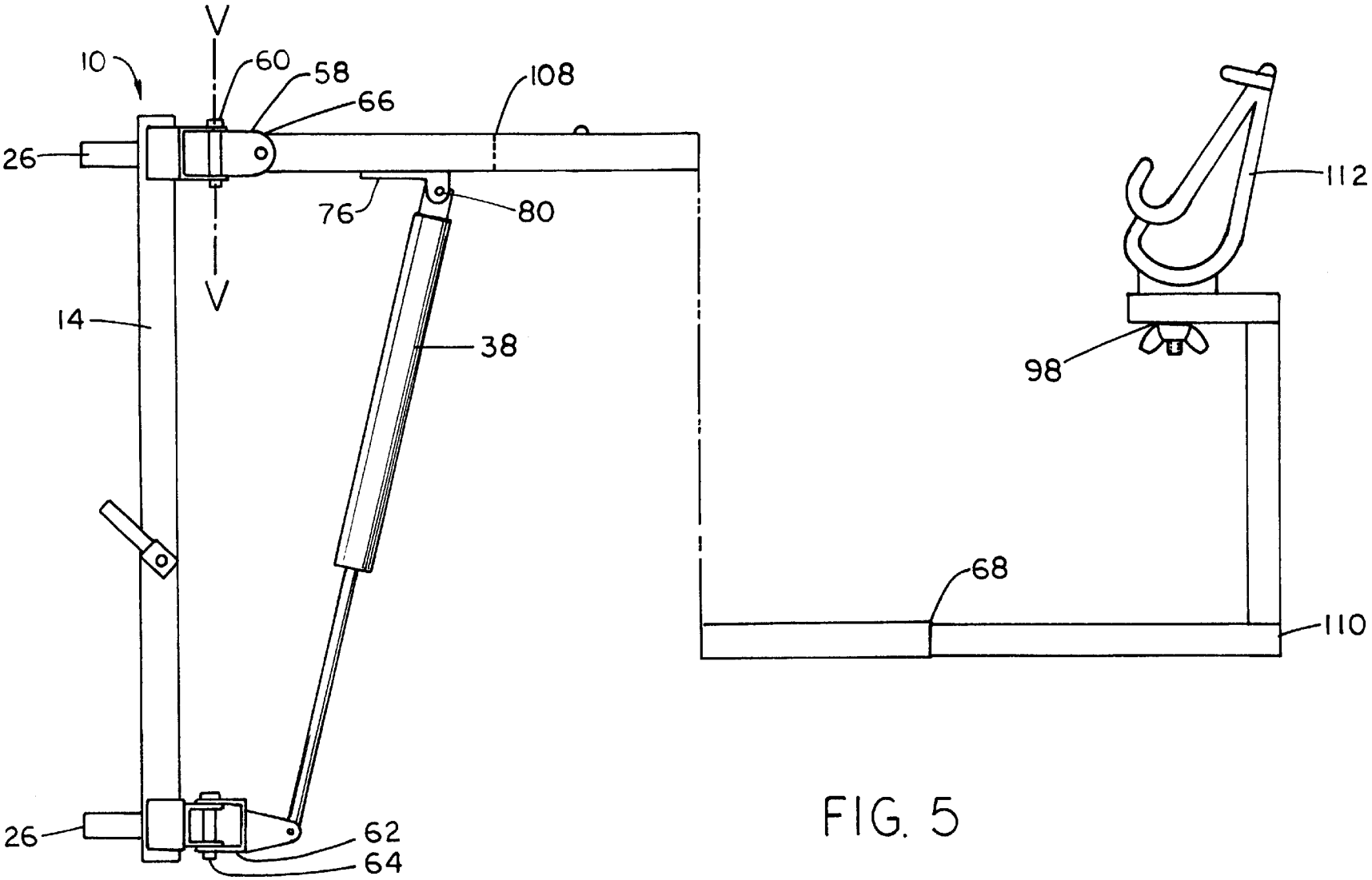
FIG. 5 is a broken side view of the device shown in FIG. 2 with the alternative attachment arm.

Turning first to FIGS. 1 and 4, the preferred embodiment of the device 10 consists of an elongated body 14 made of steel or other strong material such as aluminum or strong plastic, sufficient to support the weight of the device 10 and the bow 16. The body 14 could be made in various shapes and sizes, but the preferred version is made from a 1 inch square steel tube approximately 21 inches in length. Preferably, a dry paint or "matte" finish is applied to the device 10 where possible in order to camouflage the device 10 from view by the intended prey.

When in use, the body 14 is preferred attached to a vertical support such as a tree 12. The body 14 has an upper end 18 and a lower end 20 (FIG. 1). In the preferred embodiment, attached to the body 14 on a first side 22 thereof, are two mounting braces 24, shown more clearly in FIGS. 7 AND 8. Each of the mounting braces 24 has two angled brace arms 26 extending away from the body 14, with serrated inner edges 28. Ideally, the mounting braces 24 are affixed approximately one inch from the upper end 18 and one inch from the lower end 20 of the body 14. These mounting braces 24 are secured to the body 14 by bolts or other securing means and are configured in such a manner so as to hold the device 10 firmly against a tree 12 or other support structure, as shown in FIG. 1.

Figure 7:
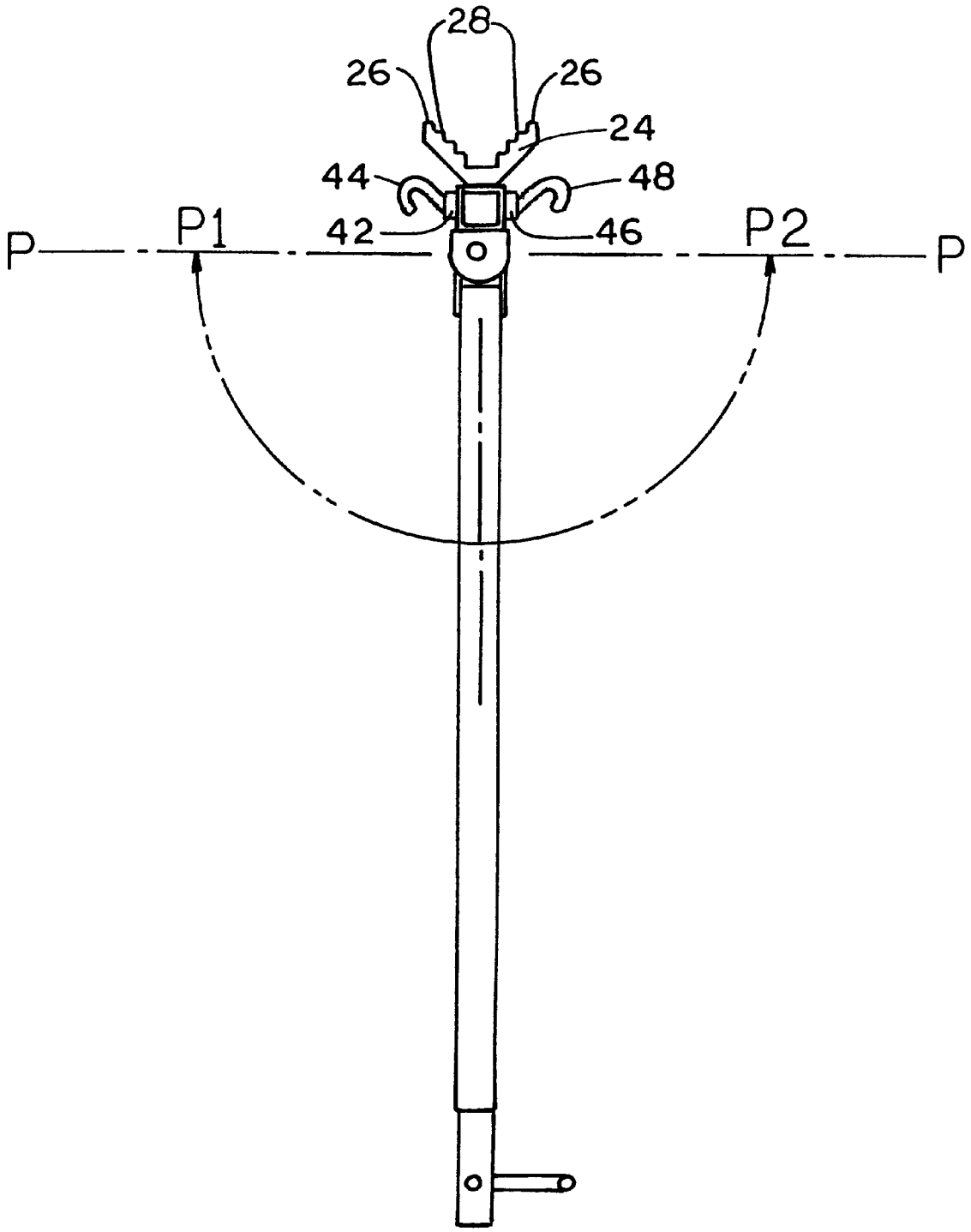
FIG. 7 is a top view of the embodiment shown in FIGS. 1 and 4.

Attached to the body 14 also by bolts or other attachment methods on a second side 30 (FIG. 4) opposite to the first side 22 and the mounting braces 24 are a first swivel attachment 32 and a second swivel attachment 34, as shown in FIG. 4. The vertical axis of a bolting cylinder 64 in the second swivel attachment 34 defines vertical attachment axis V—V. The first swivel attachment 32 and the second swivel attachment 34 connect the arm 36 of the device 10 and hydraulic cylinder 38 to the body 14. The arm 36, when horizontal, is perpendicular to a plane P—P containing the vertical attachment axis V—V. The first swivel attachment 32 and the second swivel attachment 34 allow the arm 36 to rotate horizontally up to 180 degrees around the body 14 from a first point P1 on the plane to a second point P2 on the plane as shown in FIG. 7. An alternative embodiment of the device could include a more rounded body 14 which may allow more than a 180 degree rotation of the arm 36. However, it is believed that 180 degree rotation is sufficient to meet most hunters' needs.

Ideally, the device 10 is removably attached to a vertical support such as a tree 12 by means of a mounting strap 40, as seen in FIG. 1. In the preferred embodiment, as seen in FIG. 7, which is a top view of the device 10, attached to the body 14 on a third side 42 thereof is a first curved body hook 44 and on the fourth side 46 thereof and opposite to the third side 42 is a second curved body hook 48.

The mounting strap 40 can be attached to the device 10 in many ways although, in the preferred embodiment, the strap 40 is attached by looping a first strap end 50 over the first curved body hook 44 (FIG. 1) and the second strap end 52 around the tree 12 and over the second curved body hook 48 (FIG. 7) in similar fashion. The strap 40 can then be tightened with a clamping or cinching method, so that it remains firmly in place while the device 10 is in use, but can easily be removed when it is desirable to do so.

The three different embodiments of the device 10 shown in FIGS. 1–6 in perspective and side views all have the same basic structure discussed above. The individual features of each of the three embodiments will now be addressed.

FIGS. 1 and 4 illustrate the preferred embodiment of the device 10. In this embodiment, the device 10 is attached to the tree 12 above the tree stand 54, if one is used, at a comfortable height for the hunter 56. In this configuration, a first swivel bracket 58, configured as shown in FIG. 4 in side view, is attached to the first swivel attachment 32 by means of a clevis pin 60 in the manner shown.

As also shown in FIG. 4, a second swivel bracket 62 is attached to the second swivel attachment 34, with a clevis pin 63 placed through a bolting cylinder 64 that is welded to second swivel bracket 62. The second swivel bracket 62 is bolted to the arm 36, preferably made of a 1 inch square steel tube, in such a manner so as to allow the vertical rotation of the arm 36 in a direction toward the body 14. The arm 36 has a first end 66 and an open end 68 and is attached to the second swivel bracket 62 at its first end 66. The arm 36 is preferably 21 inches in length, but may be extended in length in the manner hereinafter described.

Figure 8:
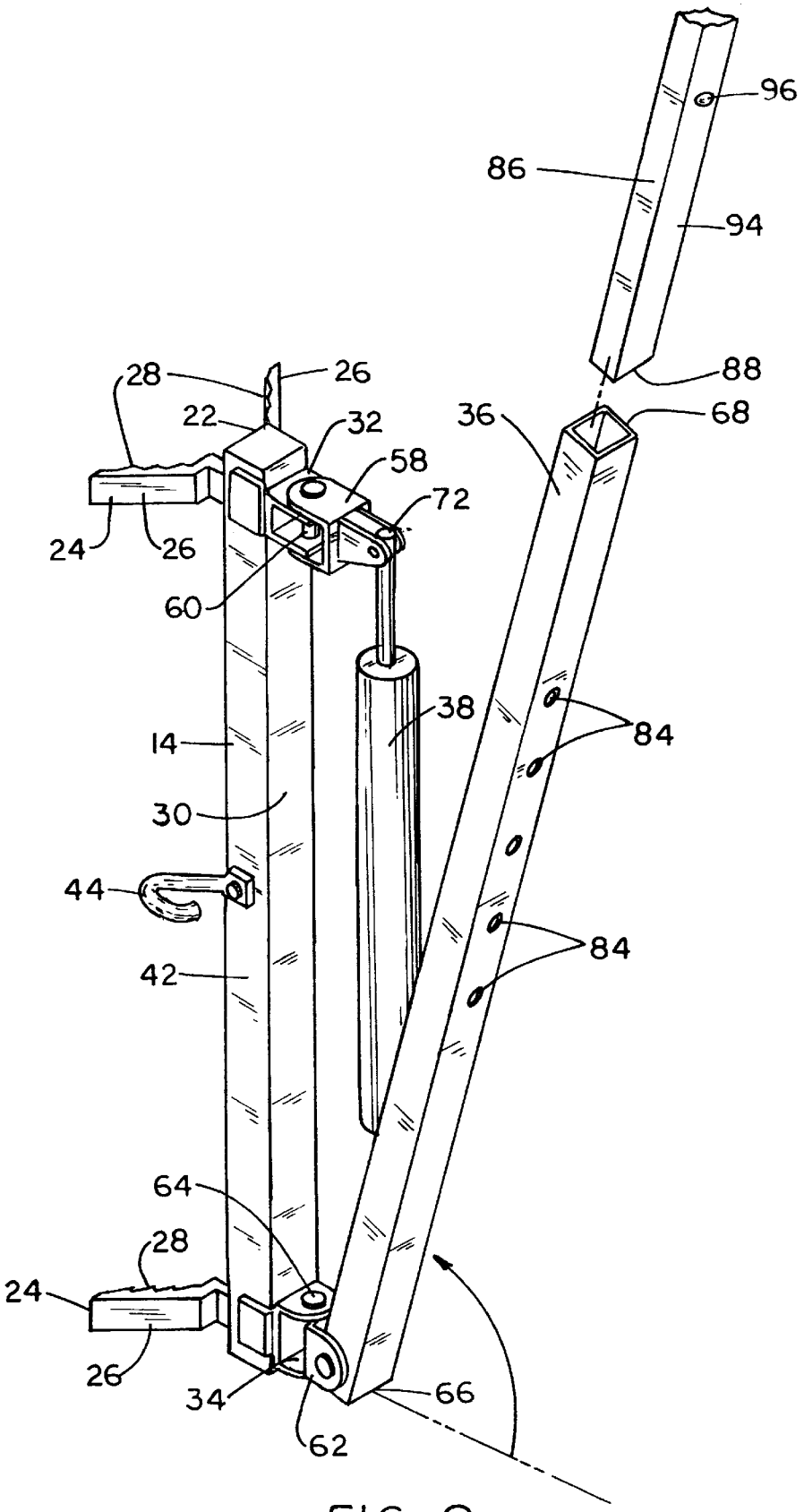
FIG. 8 is a perspective view of the embodiment shown in FIGS. 1, 4 and 5, with parts broken away, showing the device in partially collapsed or retracted form.

In the preferred embodiment and as shown in FIG. 8, the arm 36 has an underside 82 through which a series of small arm holes 84 are drilled. As shown in FIG. 8, into the open end 68 is inserted the first arm extension piece 86, which is also a square steel tube of slightly smaller dimensions than the arm 36, thereby allowing the first arm extension piece 86 to be inserted at the first arm extension piece first end 88 into the arm 36 at its open end 68. The first arm extension piece 86 is ideally 18.5 inches in length and is closed at its first arm extension piece second end 90 by a square plastic tab 92, as shown in FIG. 4.

Turning back to FIG. 8, approximately 2 inches from the first arm extension piece first end 88 on the first arm extension piece underside 94 is a retractable metal tab 96, which will retract if force is applied to it. This metal tab is of a size and shape such that when the first arm extension piece 86 is inserted into the open end 68 of the arm 36 and moved in the direction of the body 14, the tab 96 will engage each of the holes 84 in the underside 82 of the arm in turn as desired, and thereby hold the first arm extension piece 86 firmly in place in the desired length. By this method, the length of the first arm extension piece 86 protruding from the arm 36 may be adjusted and thereby the total overall length of the arm 36—first arm extension piece 86 combination may be varied.

Turning now to FIG. 4, approximately 1 inch from the second end of the arm extension piece 90, a hook mounting hole 98 is drilled from the top of the first arm extension piece 86 through the first arm extension piece underside 94 and through this hole 98 a hook 102 or other bow holding configuration can be bolted.

As shown in FIG. 4, hydraulic cylinder 38, similar to those used in outside doors to ensure automatic closure, is attached at the rod end 72 to the first swivel bracket 58 by bolt and nut means, as more particularly shown in FIG. 8. It is attached at the cylinder end 74 to a metal plate 76 bolted to the upper side 78 of the arm 36, approximately 5 to 6 inches along the arm, measuring from the first end 66. The cylinder end 74 is attached by means of a third swivel bolt 80 or by some other means which allows it to rotate approximately 45–90 degrees.

The hydraulic cylinder 38 pulls the arm 36 upwardly toward the body 14 unless sufficient weight is applied to the arm 36 to hold it in a position perpendicular to the body 14. This perpendicular position is the maximum open position of the arm 36. The hydraulic cylinder 38 is rotatable and, by means of such rotation, the upward force on the arm 36 can be varied, making the rate of movement of the arm 36 slower or faster, as desired by the user.

The device 10 is designed so that when a typical bow 16 used in deer hunting is placed on the hook 102, the arm 36 will remain in the horizontal position. When the bow 16 is removed, the arm 36 gradually is drawn by hydraulic forces toward the body 14 in an upwardly direction in the manner shown in FIG. 8. The cylinder 38 also preferably has a locking mechanism similar to that found on similar devices used on doors, which can hold the device 10 in the "open" or horizontal position relative to the body 14, or such other position as desired by the user, without maintaining downward force on the second end of the first arm extension piece 90.

When the device 10 is used in hunting, the arm 36 may be rotated horizontally and aimed in the direction of the prey and then the bow 16 removed from the hook 102, resulting in the retraction of the arm 36. The hunter then can aim, draw the bow 16 and release an arrow in the direction of the prey.

The retraction of the arm 36 toward the body 14 is very desirable when used in hunting since the arm 36 and hook 102 move quietly and slowly out of the hunter's way when the bow 16 is removed, allowing him a clear line of vision in aiming at his prey. If the hunter desires to return the arm 36 to its horizontal position, he can simply lift up his bow 16 and grasp the hook 102 with the upper edge of the bow 104, thereby returning the bow 16 to its former position.

The retraction feature of the device 10 is also beneficial when the hunter desires to carry the device 10 since the device 10 can collapse on itself and the mounting strap 40 may be lengthened and used as a shoulder strap to carry the device 10. Alternatively, the first arm extension piece 86 can be removed from the arm 36 and wrapped together with the rest of the device 10 with the mounting strap 40 for easy carrying.

FIGS. 2 and 5 show the preferred embodiment described above attached to a tree 12 in an upside-down fashion with a second arm extension piece 106. In this embodiment, the body 14 of the device 10 is inverted, the first arm extension piece 86 (as shown in FIG. 4) is removed and a second arm extension piece 106, as shown in FIGS. 2 and 5, is inserted in the open end 68 of the arm 36. This embodiment is designed to be mounted on the tree 12 under the tree stand 54 and does not retract. The arm 36 is maintained in horizontal position perpendicular to the body 14 by means of the locking mechanism on the cylinder 38 when in use, although it can be collapsed for easy transport. Alternatively, this embodiment could be manufactured without the cylinder 38. Similarly to the first embodiment described above and shown in FIG. 4, the second embodiment has a first swivel bolt 60 which defines a vertical attachment axis V—V along its length, around which the arm 36 may be rotated horizontally up to 180 degrees.

In this second embodiment, the second arm extension piece 106 is made of similar material to the first arm extension piece 86, but is configured somewhat differently. The second arm extension piece 106 is ideally 23 inches on its longest side, and includes the retractable metal tab 96, similar to the first arm extension piece 86, so that the second arm extension piece first end 108 can be inserted into the open end 68 of the arm 36 and held securely in place at the desired length (See FIG. 8).

However, the second arm extension piece second end 110 extends upwardly at a right angle from the second arm extension piece 106 some 9.5 inches and then back toward the body 14 at another right angle for approximately 4 inches before terminating. As shown in FIGS. 2 and 5, this allows the arm 36 to extend up and above the tree stand 54, so that the second arm extension piece second end 110 will be visible to the hunter when sitting or standing in the stand 54. Attached to the second arm extension piece second end 110, approximately 1–2 inches from the end thereof and bolted thereto, is a bow support bracket 112, on which the bow 16 can be secured when not in use.

Figure 6:
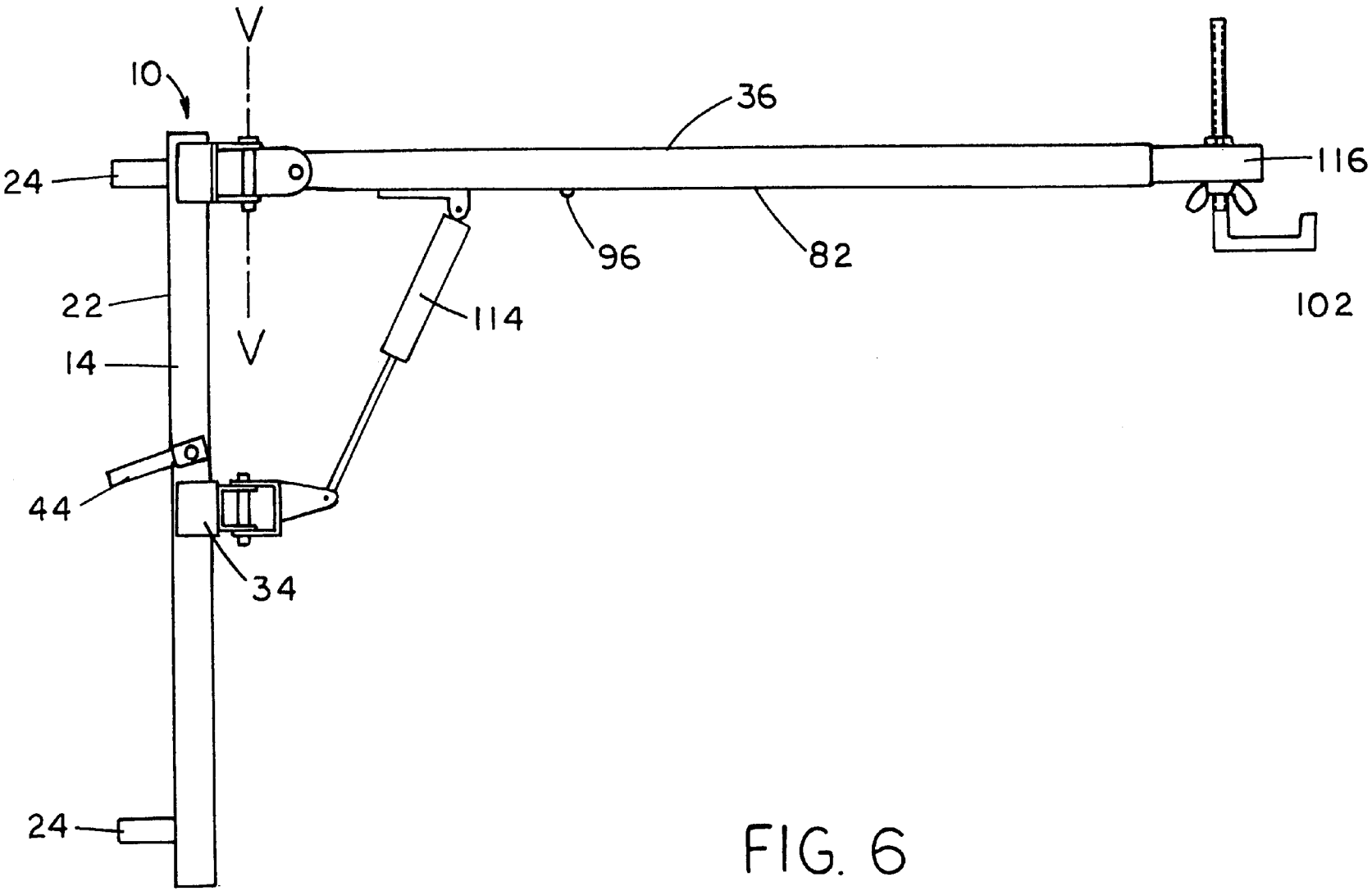
FIG. 6 is a side view of the third embodiment of the device, as shown in FIG. 3.

A third embodiment of the device 10 is shown in FIGS. 3 and 6. In this embodiment, the device 10 is inverted, similar to the second embodiment, with several important changes in design. In this third embodiment, a gas cylinder 114, with forces pushing in the opposite direction to those of the hydraulic cylinder 38 is used, so that the arm 36 pushes upwardly toward the tree 12 or other vertical support instead of pulling toward the body 14 of the device 10. In this embodiment, the maximum upward movement of the arm 36 from horizontal is approximately 45 degrees. This embodiment also provides the same method of attachment of the arm 36 to the body 14 to allow horizontal rotation around vertical attachment axis V—V up to 180.

Furthermore, as shown in FIG. 6, in this embodiment of the device 10, the placement of the second swivel attachment 34 is directly below the first curved body hook 44 and the second curved body hook 48 (as seen in FIG. 7), instead of opposite the mounting braces 24. Similar to the previously described embodiments, arm holes 84 (see FIG. 8) are drilled on the underside of the arm 82 for purposes of receiving the retractable tab 96 of the third arm extension piece 116. The third arm extension piece 116, which is similar to the first arm extension piece 86 shown in the first embodiment, can be inserted into the open end 68 of the arm 36 and locked in place as previously described. A hook 102 is then bolted into place through the third arm extension piece 116 in such a fashion such that it hangs beneath the arm 36.

The device 10 may also be configured without the use of any extension piece whatsoever, in which case the arm 36 would be lengthened and the hook 102 or bracket 112 (FIG. 5), as the case may be, would be affixed in the manner described above to the second end 68 of the arm 36. Under such circumstances, the arm 36 would not be adjustable in length.

While the principles of the invention have been described in connection with exemplary embodiments, it should be understood clearly that such descriptions are by way of example and are not limiting.

What is claimed is:

1. A bow hunting device for use in holding a bow which may be removably mounted to a vertical support, comprising:

means for removably mounting the device;

a body, having an upper end and a lower end;

an arm, having a first end and a second end, which said first end is attached to the lower end of the body;

means for removably holding the bow at the second end of the arm;

means for keeping the arm in a horizontal position when the device is mounted and when weight is applied to the bow holding means; and means to cause the second end of the arm to automatically move toward the upper end of the body when weight is removed from said bow holding means.

2. The device of claim 1 wherein the arm is adjustable in length.

3. The device of claim 1 wherein the arm is rotatable horizontally around the body.

4. The device of claim 1 wherein:

the arm is connected to the lower end of the body by arm attachment means having a vertical attachment axis there through;

the arm, when horizontal, is perpendicular to a plane containing the vertical attachment axis; and the arm may be rotated horizontally up to 180 degrees from a point on the plane to another point on the plane.

5. The device of claim 1 wherein the means for removably mounting the device is a mounting strap, with means to tighten or loosen said strap in combination with at least two braces which are attached to the body.

6. The device of claim 1 wherein the means for removably holding a bow at the second end of the arm is a hook, wherein the hook is adjustable vertically relative to the arm.

7. The device of claim 1 wherein the means for keeping the arm in a horizontal position when weight is applied to the bow holding means and for causing the arm to move upwardly toward the upper end of the body when weight is removed from said bow holding means is a hydraulic cylinder mounted between the body and the arm, wherein the hydraulic cylinder pulls the arm upwardly when weight is removed from the bow holding means and further wherein the hydraulic cylinder is adjustable for rate of movement of the arm.

8. A hunting device for use in holding a bow which may be removably attached to a vertical support, comprising:

means for removably attaching the device;

a body, having an upper end and a lower end;

an arm, having a first end and a second end, which said first end is attached to the upper end of the body;

means for removably holding the bow at the second end of the arm; and means for keeping the arm in a horizontal position when the device is attached and when weight is applied to the bow holding means and for causing the arm to move upwardly toward a vertical position when weight is removed from said bow holding means.

9. The device of claim 8 wherein the arm is adjustable in length.

10. The device of claim 8 wherein the arm is rotatable horizontally around the body.

11. The device of claim 8 wherein:

the arm is connected to the upper end of the body by arm attachment means having a vertical attachment axis therethrough;

the arm, when horizontal, is perpendicular to a plane containing the vertical attachment axis; and the arm may be rotated up to 180 degrees from a point on the plane to another point on the plane.

12. The device of claim 8 wherein the means for removably attaching the device is a mounting strap, with means to tighten and loosen said strap in combination with at least two braces which are attached to the body.

13. The device of claim 8 wherein the means for holding a bow at the second end of the arm is a hook wherein the hook is adjustable vertically relative to the arm.

14. The device of claim 8 wherein the means for keeping the arm in a horizontal position when weight is applied to the bow holding means and for causing the arm to move upwardly toward a vertical position when weight is removed from said bow holding means is a gas cylinder mounted between the body and the arm wherein the gas cylinder pushes the arm upwardly when weight is removed from the bow holding means.

15. A hunting device for use in holding a bow which may be removably mounted to a vertical support, comprising:

means for removably attaching the device;

a body;

an arm, having a first end and a second end, which said first end is connected to the body by attachment means having a vertical attachment axis; and means for removably holding a bow at the second end of the arm, wherein the arm is at least partially rotatable horizontally around the vertical attachment axis.

16. The device of claim 15 wherein the arm is adjustable in length.

17. The device of claim 15 wherein the arm, when horizontal, is perpendicular to a plane containing the vertical attachment axis and further wherein the arm may be rotated horizontally up to 180 degrees around the vertical attachment axis.

18. The device of claim 15 wherein the means for removably attaching the device is a mounting strap, with means to tighten or loosen said strap.

19. The device of claim 15 wherein at least two braces are attached to the body.

20. The device of claim 15 wherein the means for removably holding the bow is a bracket affixed to the second end of the arm.

* * * * *

UNITED STATES PATENT AND TRADEMARK OFFICE

CERTIFICATE OF CORRECTION

PATENT NO. : 6,059,240
DATED : May 9, 2000
INVENTOR(S) : Timothy M. Gorsuch

It is certified that error appears in the above-indentified patent and that said Letters Patent is hereby corrected as shown below:

Column 5, line 28, change "preferred" to --Preferably--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*